US008672688B2

(12) United States Patent
Florence, Jr. et al.

(10) Patent No.: US 8,672,688 B2
(45) Date of Patent: Mar. 18, 2014

(54) LAND GRID ARRAY INTERPOSER WITH COMPRESSIBLE CONDUCTORS

(75) Inventors: Robert F. Florence, Jr., Poughkeepsie, NY (US); Emanuele F. Lopergolo, Marlboro, NY (US); Prabjit Singh, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 122 days.

(21) Appl. No.: 13/351,731

(22) Filed: Jan. 17, 2012

(65) Prior Publication Data

US 2013/0183872 A1 Jul. 18, 2013

(51) Int. Cl.
*H01R 12/00* (2006.01)

(52) U.S. Cl.
USPC ..... 439/66

(58) Field of Classification Search
USPC ..... 439/66, 71, 817
See application file for complete search history.

(56) References Cited

U.S. PATENT DOCUMENTS 3,873,173 A * 3/1975 Anhalt ..... 439/71
4,505,529 A * 3/1985 Barkus ..... 439/82
4,647,124 A * 3/1987 Kandybowski ..... 439/71
5,015,191 A * 5/1991 Grabbe et al. ..... 439/71
5,092,783 A * 3/1992 Suarez et al. ..... 439/71
5,139,427 A * 8/1992 Boyd et al. ..... 439/66
5,259,769 A * 11/1993 Cruise et al. ..... 439/65
5,299,939 A 4/1994 Walker et al.
5,380,210 A * 1/1995 Grabbe et al. ..... 439/66
5,395,252 A * 3/1995 White ..... 439/66
5,427,535 A * 6/1995 Sinclair ..... 439/66
5,655,913 A * 8/1997 Castaneda et al. ..... 439/66
5,820,389 A * 10/1998 Hashiguchi ..... 439/66
5,957,703 A 9/1999 Arai et al.
5,984,693 A * 11/1999 McHugh et al. ..... 439/66

(Continued)

FOREIGN PATENT DOCUMENTS

JP 2010-125428 A 6/2010
WO 2010/072643 A1 6/2011

OTHER PUBLICATIONS

Notification of Transmittal of the International Search Report and the Written Opinion of the International Searching Authority, or the Declaration, issued for PCT Application No. PCT/IB2013/050082, filed Jan. 4, 2013, dated Mar. 30, 2013 (12 pages).

*Primary Examiner* — Amy Cohen Johnson
*Assistant Examiner* — Vladimir Imas
(74) *Attorney, Agent, or Firm* — Dennis Jung, Esq.; Kevin P. Radigan, Esq.; Heslin Rothenberg Farley & Mesiti P.C.

(57) ABSTRACT

An electrical interconnect is provided for use within, for example, a land grid array (LGA) interposer such as a module-to-board connector. The electrical interconnect includes an electrically-conductive, compressible conductor which has a first conductor end portion and a second conductor end portion. The first and second conductor end portions physically contact in slidable relation each other with compression of the compressible conductor to facilitate inhibiting rotation of the compressible conductor. In one embodiment, the first end portion includes at least one first leg and the second end portion includes at least two second legs, and the at least one first leg and at least two second legs are interdigitated. Further, in one embodiment, the first end portion and the second end portion are each in slidable contact with an inner-facing surface of the compressible conductor.

17 Claims, 8 Drawing Sheets

(56) References Cited

U.S. PATENT DOCUMENTS

| | | | | |
|---|---|---|---|---|
| 6,241,531 | B1 * | 6/2001 | Roath et al. | 439/66 |
| 6,280,254 | B1 * | 8/2001 | Wu et al. | 439/630 |
| 6,290,507 | B1 * | 9/2001 | Neidich et al. | 439/66 |
| 6,315,576 | B1 * | 11/2001 | Neidich | 439/66 |
| 6,328,573 | B1 * | 12/2001 | Sakata et al. | 439/66 |
| 6,345,987 | B1 * | 2/2002 | Mori et al. | 439/66 |
| 6,398,559 | B2 * | 6/2002 | Tanaka | 439/66 |
| 6,532,654 | B2 * | 3/2003 | Guerin et al. | 29/884 |
| 6,730,134 | B2 * | 5/2004 | Neidich | 29/25.01 |
| 6,731,516 | B1 * | 5/2004 | Ma | 361/802 |
| 6,821,163 | B2 * | 11/2004 | McHugh et al. | 439/733.1 |
| 6,881,070 | B2 * | 4/2005 | Chiang | 439/66 |
| 6,905,343 | B1 * | 6/2005 | Neidich | 439/66 |
| 6,974,332 | B2 * | 12/2005 | Ma | 439/66 |
| 6,981,880 | B1 | 1/2006 | Brodsky et al. | |
| 7,040,902 | B2 * | 5/2006 | Li | 439/66 |
| 7,048,549 | B1 * | 5/2006 | Swain | 439/66 |
| 7,052,284 | B2 * | 5/2006 | Liao et al. | 439/66 |
| 7,094,066 | B2 * | 8/2006 | Mendenhall et al. | 439/66 |
| 7,118,385 | B1 | 10/2006 | Bodenweber et al. | |
| 7,167,379 | B2 * | 1/2007 | DiBene et al. | 361/785 |
| 7,196,907 | B2 * | 3/2007 | Zheng | 361/760 |
| 7,255,574 | B1 | 8/2007 | Ju | |
| 7,284,992 | B2 | 10/2007 | Becker et al. | |
| 7,338,294 | B2 * | 3/2008 | Polnyi | 439/66 |
| 7,378,742 | B2 * | 5/2008 | Muthukumar et al. | 257/773 |
| 7,402,049 | B2 * | 7/2008 | Polnyi | 439/66 |
| 7,427,203 | B2 * | 9/2008 | Liao | 439/66 |
| 7,467,951 | B2 | 12/2008 | Hougham et al. | |
| 7,479,014 | B2 | 1/2009 | Hougham et al. | |
| 7,503,770 | B2 * | 3/2009 | Fan | 439/66 |
| 7,520,753 | B1 * | 4/2009 | Mulligan et al. | 439/66 |
| 7,559,811 | B1 * | 7/2009 | Polnyi | 439/862 |
| 7,607,952 | B2 * | 10/2009 | Tai | 439/700 |
| 7,614,883 | B2 * | 11/2009 | Mendenhall et al. | 439/66 |
| 7,621,755 | B2 * | 11/2009 | Kubo et al. | 439/66 |
| 7,625,216 | B2 * | 12/2009 | Mendenhall et al. | 439/66 |
| 7,665,999 | B2 | 2/2010 | Hougham et al. | |
| 7,736,152 | B2 | 6/2010 | Hougham et al. | |
| 7,775,804 | B2 | 8/2010 | Neidich et al. | |
| 7,832,095 | B2 | 11/2010 | Hougham et al. | |
| 7,841,078 | B2 | 11/2010 | Lam et al. | |
| 7,905,730 | B2 | 3/2011 | Sakamoto et al. | |
| 7,950,928 | B2 * | 5/2011 | Szu | 439/70 |
| 7,972,149 | B2 * | 7/2011 | Ihara | 439/81 |
| 8,037,600 | B2 | 10/2011 | Hougham et al. | |
| 8,118,604 | B2 * | 2/2012 | Ma | 439/70 |
| 8,162,673 | B2 * | 4/2012 | Chen | 439/66 |
| 8,460,011 | B2 * | 6/2013 | Adachi | 439/66 |
| 2003/0234451 | A1 | 12/2003 | Razon | |
| 2007/0052111 | A1 | 3/2007 | Long et al. | |
| 2009/0119916 | A1 | 5/2009 | Hougham et al. | |
| 2011/0111647 | A1 | 5/2011 | Hougham et al. | |

* cited by examiner

LAND GRID ARRAY INTERPOSER WITH COMPRESSIBLE CONDUCTORS

BACKGROUND

Land grid array (LGA) interposers, by way of example, provide an array of interconnections between a printed wiring board (PWB) and a chip module, such as a multichip module (MCM), among other kinds of electrical or electronic devices. LGA interposers allow connections to be made in a way which is reversible and do not require soldering as, for instance, with ball grid arrays or column grid arrays. Ball grid arrays are deemed to be somewhat unreliable on larger areas because the lateral thermal coefficients of expansion-driven stresses that develop can exceed the ball grid array strength. Column grid arrays hold together despite the stresses, but are still soldered solutions, and thus, do not allow for field replaceability, which can be significant since replaceability could potentially save a customer costs in the maintenance and upgrading of high-end computers for which LGAs are typically used.

Various types of LGA interposer structures have been developed, but generally include, for instance, rigid, semi-rigid, or flexible substrate structures having arrays of electrical contacts formed by, for example, spring structures, metal-elastomer composites, wadded wire, etc. State of the art LGA techniques enable MCM-to-board interconnections with I/O interconnect densities/counts and electrical/mechanical properties that are desirable for high-performance CPU module designs. Moreover, LGA provides electrical and mechanical interconnect techniques that allow MCM chip modules to be readily removable from wiring or circuit boards, which is advantageous for high-end modules such as CPU packages which may require repeated re-work during production or are designed to be field-upgradable.

BRIEF SUMMARY

In one aspect, provided herein is an electrical interconnect which includes an electrically-conductive, compressible conductor. The electrically-conductive, compressible conductor includes a first conductor end portion and a second conductor end portion. The first conductor end portion and the second conductor end portion physically contact in slidable relation to each other with compression of the electrically-conductive, compressible conductor to, at least in part, facilitate inhibiting rotation of the electrically-conductive, compressible conductor with compression thereof.

In another aspect, an electrical apparatus is provided which includes an interposer, and a plurality of electrically-conductive, compressible conductors disposed within the interposer. At least one electrically-conductive, compressible conductor of the plurality of electrically-conductive, compressible conductors comprises a first conductor end portion and a second conductor end portion, wherein the first conductor end portion and the second conductor end portion physically contact in slidable relation to each other with compression of the at least one electrically-conductive, compressible conductor to, at least in part, facilitate inhibiting rotation of the at least one electrically-conductive, compressible conductor with compression thereof.

In a further aspect, a method of fabricating an electrical interconnect is provided, which includes: providing an interposer; providing an electrically-conductive, compressible conductor; and disposing the electrically-conductive, compressible conductor within the interposer, wherein in uncompressed state, the electrically-conductive, compressible conductor extends beyond a first surface and a second surface of the interposer, the first and second surfaces being opposite main surfaces of the interposer. The electrically-conductive, compressible conductor includes a first conductor end portion and a second conductor end portion, wherein the first conductor end portion and the second conductor end portion physically contact in slidable relation to each other with compression of the at least one electrically-conductive, compressible conductor to facilitate inhibiting rotation of the at least one electrically-conductive, compressible conductor with compression thereof.

Additional features and advantages are realized through the techniques of the present invention. Other embodiments and aspects of the invention are described in detail herein and are considered a part of the claimed invention.

BRIEF DESCRIPTION OF THE SEVERAL VIEWS OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1A:
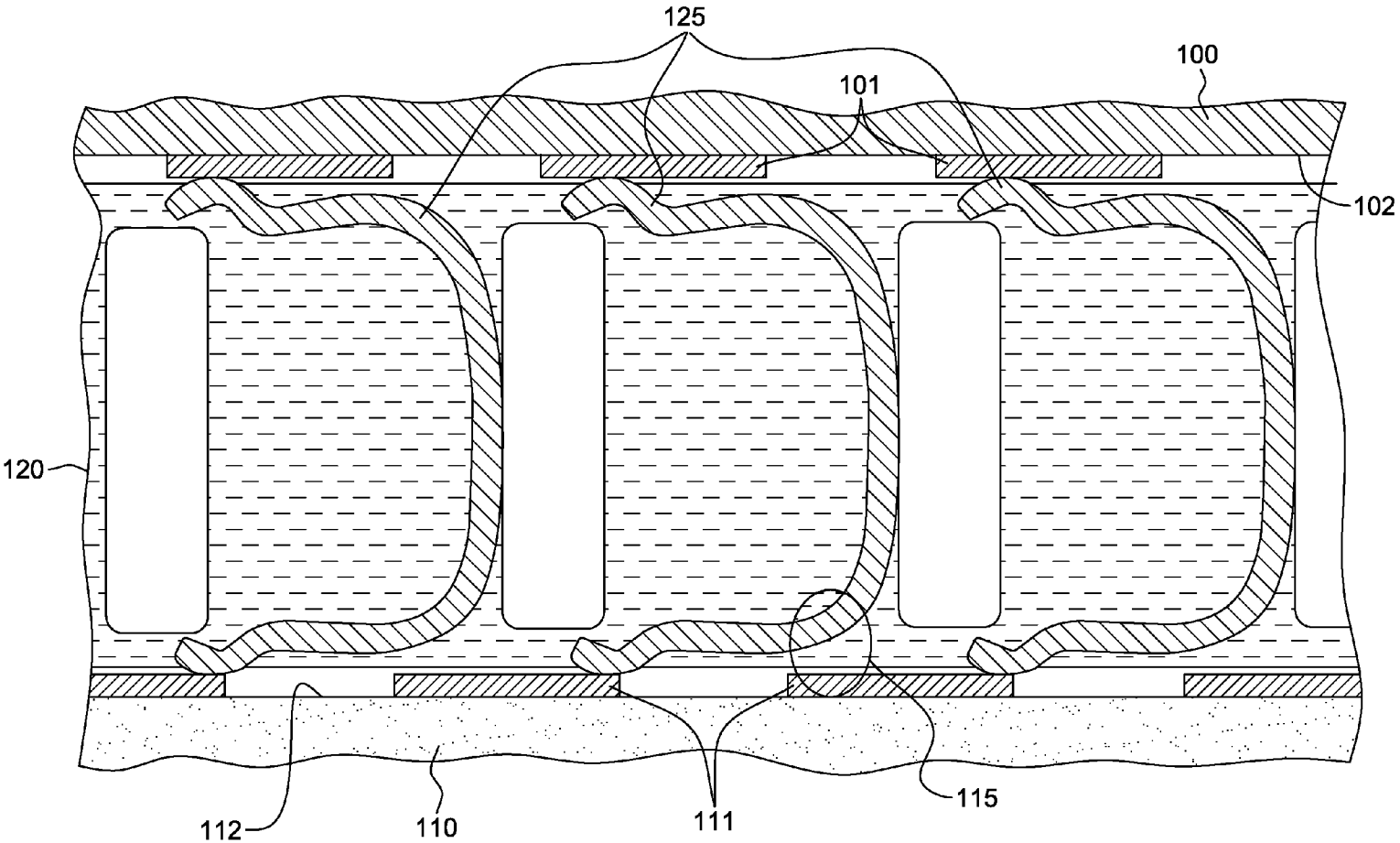
FIG. 1A (PRIOR ART)
FIG. 1A depicts a partial cross-sectional elevational view of one embodiment of a conventional interposer structure, shown disposed between and electrically connecting a substrate and a wiring board.

Reference is made below to the drawings (which are not drawn to scale to facilitate understanding of the invention), wherein the same reference numbers used throughout different figures designate the same or similar components.

One widely commercially available LGA uses button contacts, each comprising siloxane rubber filled with silver particles. This structure is intended to provide a contact which possesses a rubber-like elasticity with the provision of electrical conductivity. While siloxane itself has very desirable properties for this type of application, incorporating both a low-elastic modulus and high elasticity, the particle-filled siloxane rubber system loses a significant proportion of these desirable properties under the loadings which are required for electrical conductivity. Although the modulus increases, it remains low overall, and requires only about 30-80 grams per contact to ensure good electrical reliability; however, the loss of elasticity results in creep deformation under constant load and stress relaxation under constant strain. These tendencies render electrically-conductive elastomer LGAs unreliable for high-end products which require an extraordinary stability over a lengthy period of time. Indeed, modern high-end server CPUs demand LGA failure rates at ppb levels on a per contract basis because of a total system dependence on individual signal contacts.

Because of the adverse extent of creep and stress relaxation (which has been demonstrated by the filled electrically-conductive elastomer LGAs), the industry favors the use of LGA arrays which are fabricated from random coil springs, such as for instance, a product called the Cinch Connector, which is made by the Synapse Company, of Seattle, Wash., USA. These springs have a much higher spring constant that the electrically-conductive, elastomer-type connector, but typically require greater pressure per contact in order to ensure reliable electrical connection across the array.

There is a strong technical motivating factor for using LGAs instead of rigid, direct-solder attachments between module and printed wiring board (PWB). The lateral stresses that occur due to thermal coefficient of expansion (TCE) mismatches between ceramic modules and organic PWBs are large, and direct, ball-grid-array-type connections often tend to fail. Systems are accordingly advantageous which have some built-in lateral compliance. As noted, one direct-attach solution to address this problem is a so-called "column grid array", or CGA. The CGA is a permanent, solder-type interconnection that deforms without failing in order to accommodate the lateral stresses imposed.

There is also a strong economic motivating factor for using LGA interposers over direct-attach solutions. This is because repairs and upgrades to chip sets cannot be carried out in the field with direct-attach solutions. Pressure-mounted LGAs can be replaced in the field, thereby saving the customer significant costs in disassembly, shipping and rework downtime.

Figure 1B:
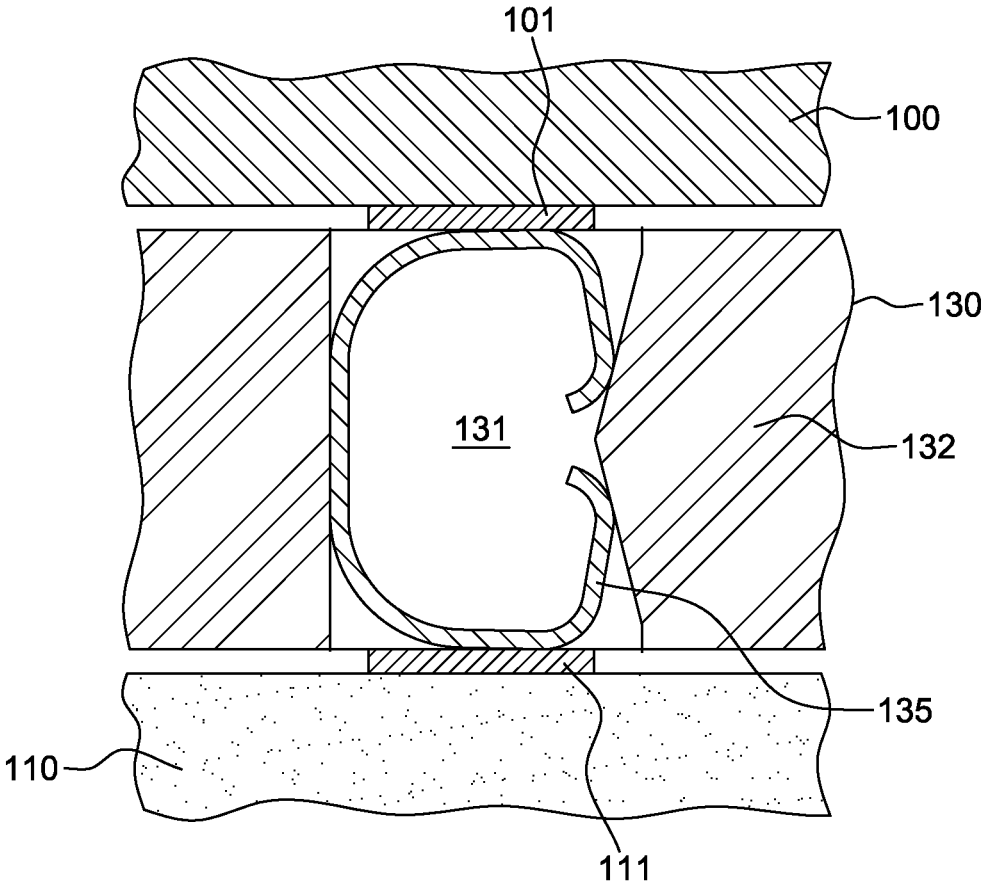
FIG. 1B (PRIOR ART)
FIG. 1B depicts a partial cross-sectional elevational view of another embodiment of a conventional interposer structure, shown disposed between and electrically connecting a substrate and wiring board.

Thus, there are both technological and economic advantages to a pressure-type LGA interposer approach. FIGS. 1A & 1B depict two current configurations of a pressure-applied type LGA interposer.

In FIG. 1A, one embodiment of a conventional, spring-type interposer structure is shown disposed between and electrically connecting a substrate 100, and a wiring board 110. By way of example, substrate 100 may comprise a module substrate having one or more integrated circuit chips (not shown) mounted to a first surface (not shown) of the substrate and a first array of contacts 101 formed on a second surface 102 of the substrate opposite to the first surface. Wiring board 110 may comprise a circuit board having a second array of contacts 111 formed on a first surface 112 thereof. As one example, the first array of contacts 101 and second array of contacts 111 may each be of pitch P1. Also shown in the electronic assembly of FIG. 1A is an interposer structure 120 comprising a plurality of spring-type connectors 125. In the embodiment illustrated, spring-type connectors 125 are C-shaped conductors which are designed to electrically interconnect (when under load) opposing contacts 101, 111 of the substrate and wiring board, respectively. Should the first array of contacts 101 and second array of contacts 111 be slightly misaligned as illustrated in FIG. 1A, then it is possible for a short circuit to arise due the proximity of one or more of the connectors 125 to one or more adjacent contacts of, for example, the first array of contacts or the second array of contacts. In FIG. 1A, the first and second arrays of contacts are misaligned such that the middle illustrated spring-type connector 125 has a bend which is in close proximity 115 with an adjacent contact of the second array of contacts 111 disposed on wiring board 110, and could result in shorting together of the two adjacent contacts 111 via the middle connector 125. Although not illustrated, a similar misalignment could also or alternatively result in shorting together one more adjacent contacts 101 disposed on module substrate 100.

FIG. 1B illustrates an alternate embodiment of a conventional interposer structure, again shown disposed between and electrically connecting module substrate 100 and wiring board 110. In this embodiment, the interposer structure 130 includes a plurality of spring-type connectors 135, one of which is illustrated, each disposed within a respective opening 131 in the interposer material 132.

Note that, in the embodiment of FIG. 1A, the spring-type connector approximates a cantilevered spring, and is prone to rotation when compressed. This (in turn can) result in a lowered normal force being applied to the contacts above and below the interposer structure. Additionally, note that the connectors illustrated in FIGS. 1A & 1B may become caught within the interposer material, bend and/or drop through the respective openings in the interposer structure housing the connectors. Also, the configurations illustrated in FIGS. 1A & 1B for the electrical connector each have only one electrical path for the signal to flow between the respective aligned upper and lower contacts, making the connection resistance between any two contacts potentially somewhat high.

Generally stated, disclosed herein is a novel electrical interconnect, such as, for example, a land grid array interposer structure. The electrical interconnect comprises an electrically-conductive, compressible conductor which includes a first conductor end portion and a second conductor end portion that extend, in one example, from a C-shaped portion. The first conductor end portion and the second conductor end portion physically contact in slidable relation to each other with compression of the electrically-conductive, compressible conductor to, at least in part, facilitate inhibiting rotation of the electrically-conductive, compressible conductor with compression thereof. In one embodiment, the first conductor end portion includes at least one first leg and the second conductor end portion includes at least two second legs, and the at least one first leg and the at least two second legs are interdigitated. Further, the first conductor end portion and second conductor end portion each physically contact in slidable relation an inner-facing surface of the electrically-conductive, compressible conductor, such as an inner-facing surface of the C-shaped portion of the electrically-conductive, compressible conductor.

Advantageously, the electrically-conductive, compressible conductor includes multiple current paths therethrough when operatively disposed in a compressed (or loaded) state between two electrically conducting contacts. At least one of these current paths passes through at least one of the first conductor end portion or the second conductor end portion. In one embodiment, both the first conductor end portion and the second conductor end portion form respective parts of separate electrical current paths through the electrically-conductive, compressible conductor. As one characterization, the electrically conductive-compressible conductor is a partially C-shaped structure, with a figure "8" defined therein via the first and second conductor end portions of the conductor. More particularly, and as explained further below, the electrically-conductive, compressible conductor disclosed herein is advantageously designed to: inhibit rotation of the conductor (or button) with compressing thereof, which avoids loss of contact force; provide good retention of the conductor within the interposer, resulting in low probability of the conductor falling out of the interposer; provide three redundant paths for current to flow, thus reducing the contact resistance; and provide a small footprint conductor, leading to low cross-talk between conductors and allowing for a high-performance connection between, for example, the module substrate and the wiring board.

Figure 2:
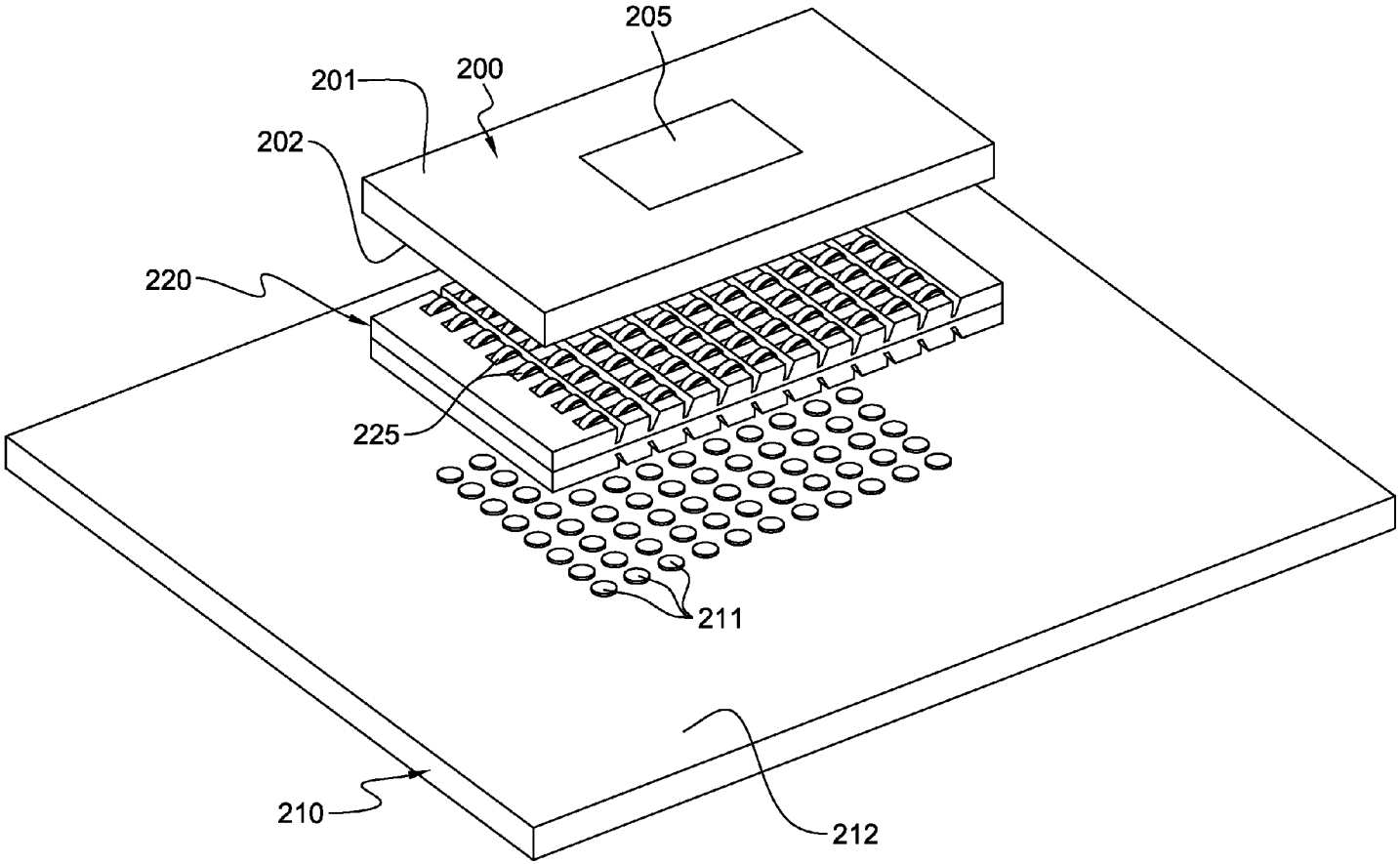
FIG. 2 is a partially exploded view of an electronic apparatus comprising one embodiment of an electrical interconnect, in accordance with one or more aspects of the present invention.

FIG. 2 depicts one embodiment of an electronic apparatus comprising an electrical interconnect such as disclosed herein disposed between a module substrate 200 and a wiring board 210. In this embodiment, the electrical interconnect is a land grid array interposer structure 220, which includes a plurality of electrically-conductive, compressible conductors 225 arrayed within the interposer structure. Module substrate 200 supports, in the embodiment depicted, one or more integrated circuit chips 205 on a first surface 201 thereof, and a first array of contacts (not shown) of pitch P1 formed on a second surface 202 of the module substrate, wherein the first surface 201 and second surface 202 are opposite surfaces of the module substrate 200. As illustrated, wiring board 210 includes a second array of contacts 211 of, for example, pitch P1 disposed on a first surface 212 thereof.

The land grid array interposer structure 220, and in particular, the plurality of electrically-conductive, compressible conductors 225 arrayed therein, provide electrical interconnection between the first and second arrays of contacts when the interposer structure is operatively disposed between substrate module 200 and wiring board 210. Compressive loading can be applied to the compressible conductors via any conventional means, such as one or more adjustable securing mechanisms (not shown), that force the module substrate and wiring board together, and thereby compress the plurality of electrically-conductive, compressible conductors 225. This compression (or loading) of the conductors creates a normal force between the conductors and the respective first and second contacts, to ensure good electrical connection therebetween.

Figure 3A:
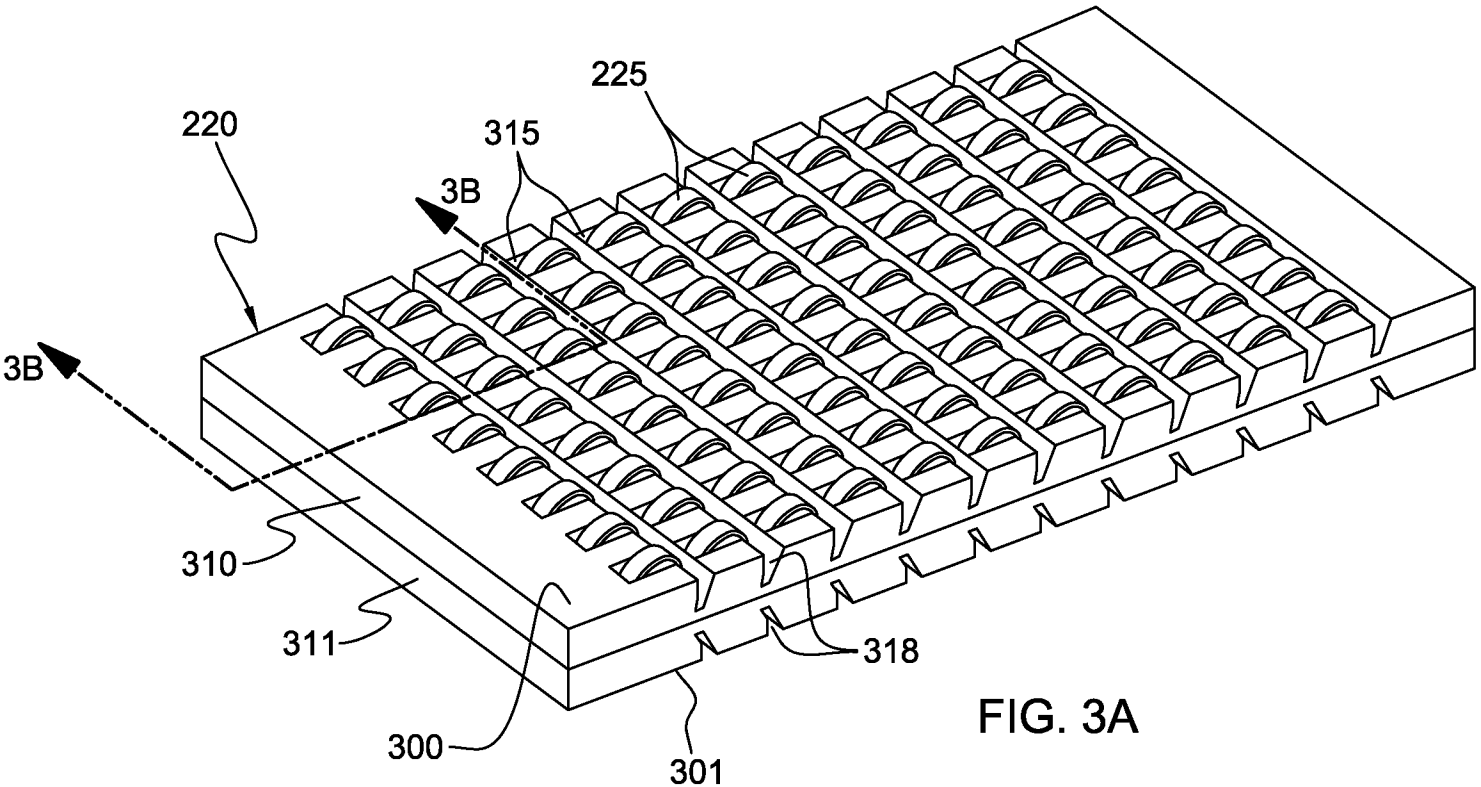
FIG. 3A is an enlarged depiction of the electrical interconnect of FIG. 2, in accordance with one or more aspects of the present invention.
Figure 3B:
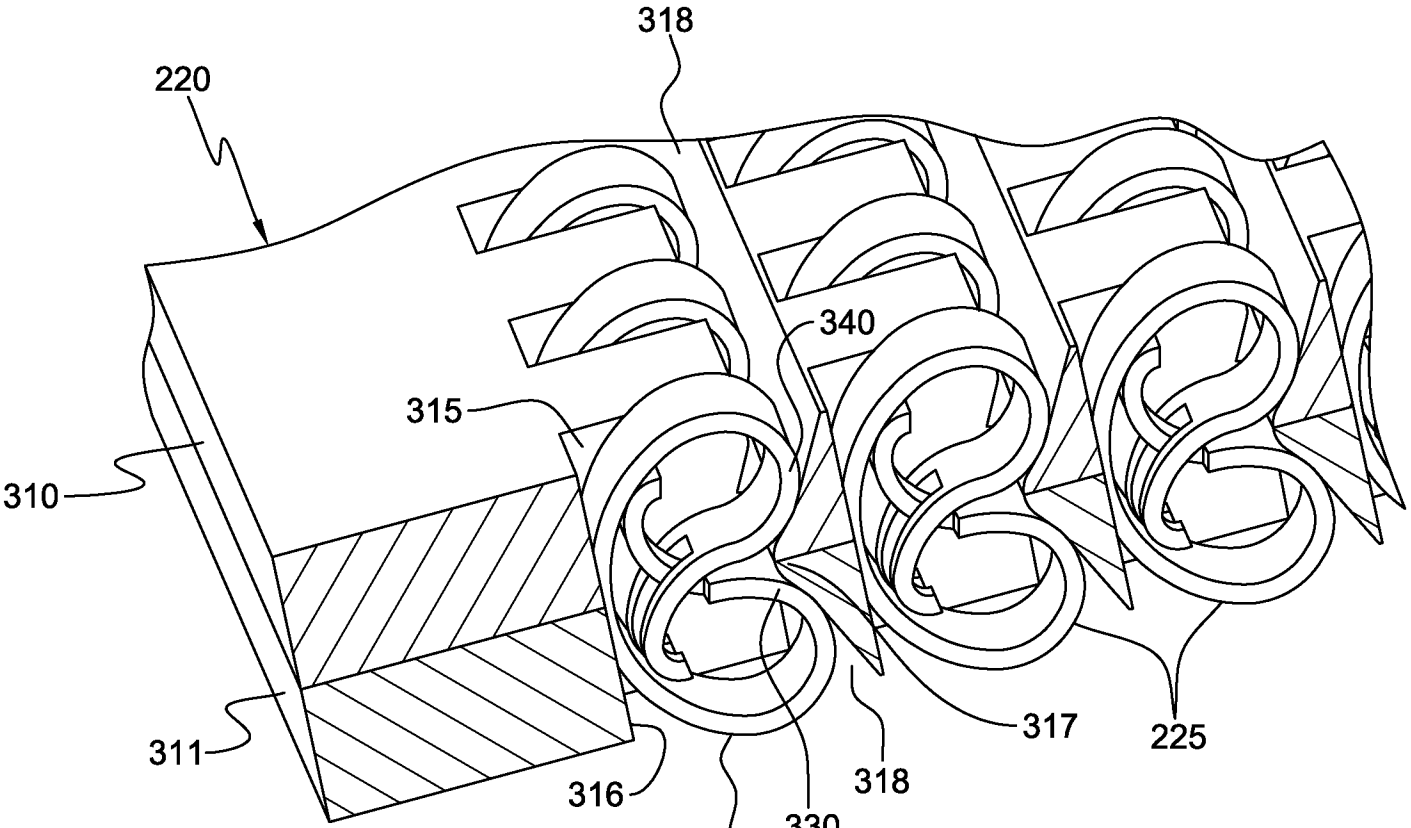
FIG. 3B is a further enlarged depiction of the electrical interconnect of FIGS. 2 & 3A, taken along line 3B-3B in FIG. 3A, in accordance with one or more aspects of the present invention.

FIGS. 3A & 3B depict in greater detail one embodiment of interposer structure 220 of FIG. 2. Referring collectively to these figures, interposer structure 220 includes, in the depicted embodiment, an upper housing portion 310 and a lower housing portion 311, which comprise two mating halves of the interposer structure. Dividing the interposer structure into two or more mating portions facilitates assembly of the plurality of electrically-conductive, compressible conductors 225 within respective openings 315 of the interposer structure 220.

As illustrated in FIG. 3B, each respective opening 315 comprises an inner side wall 316 with a side wall protrusion 317 extending at least partially between different portions of the respective electrically-conductive, compressible conductor. In one embodiment, the respective portions are the first conductor end portion 330 and second conductor end portion 340 of the compressible conductor. Note that the side wall protrusion 317 is formed, in this embodiment, by two protrusion halves, each formed in one of the upper and lower housing portions of the interposer structure, which when mated, define side wall protrusion 317. The protrusion is sized so as to extend between different portions of the compressible conductor in order to facilitate maintaining the compressible conductor in position within the respective opening, and to inhibit rotation of the compressible conductor, for example, when compressed by a loading offset from ideal. Note also with respect to FIGS. 3A & 3B, that parallel-extending channels 318 are provided in upper housing portion 310 and lower housing portion 311 to, in one embodiment, facilitate accommodating compression of the respective electrically-conductive, compressible conductors 225 when operatively disposed between, for example, the module substrate and the wiring board.

The compressible conductors 225 may be formed of any compressible, electrically-conducting material. For example, the conductors might comprise beryllium copper, which has a high yield strength, and good electrical conductivity. The interposer material (from which the interposer layer is formed) may comprise, for example, a thermo-set plastic, which has a total height less than the height of the compressible conductors, as illustrated in FIG. 3B. By way of specific example only, the interposer structure might comprise a 100×100 array of compressible conductors in an interposer structure having planar dimensions of approximately 4 inches×4 inches, and the compressible conductors might be, for example, less than 1 mm in height (such as 0.5-0.75 mm), and 0.5 mm or less in width. This results in a compact, compressible conductor (or contact button) design that has numerous advantages, as described herein, over conventional spring-type connectors.

In one embodiment, the compressible conductors 225 disclosed herein can be formed via stamping and bending a continuous, elongate conductor, such as a metal conductor having the desired yield strength to provide the needed compressibility that will facilitate the electrical interconnect functionality described herein, such as, for example, for a land grid array interposer structure. One embodiment of the compressible conductor (or contact button) is illustrated, by way of example, in greater detail in FIG. 3C, wherein compressible conductor 225 is shown to include a C-shaped portion 320, a first conductor end portion 330, and a second conductor end portion 340. As shown, the first and second conductor end portions 330, 340 respectively extend from different ends of C-shaped portion 320 in a continuous manner, and are in slidable contact with each other so as to accommodate loading or unloading of the compressible conductor. As illustrated, first conductor end portion 330 includes at least one first leg 332 and second conductor end portion 340 includes at least two second legs 342, which are shown interdigitated, with a single first leg 332 shown extending between two second legs 342. Further, note that the first conductor end portion 330 and second conductor end portion 340, and more particularly, the at least one first leg 332 and at least two second legs 342 thereof, are in slidable, physical contact with an inner-facing surface 321 of the C-shaped portion 320 of the electrically-conductive, compressible conductor 225. This slidable contacting of the first and second end portions with the inner-facing surface of the C-shaped portion facilitates stabilizing the compressible conductor during loading and unloading thereof; and significantly, provides multiple current paths through the compressible conductor, as described further below in relation to the assembled electronic apparatus of FIGS. 4A-4C. Also note the inwardly-curved ends of the at least one first leg 332 and at least two second legs 342.

These curved (or smaller radii) ends prevent the legs from digging into inner-facing surface 321 of the C-shaped portion 320.

Figure 3C:
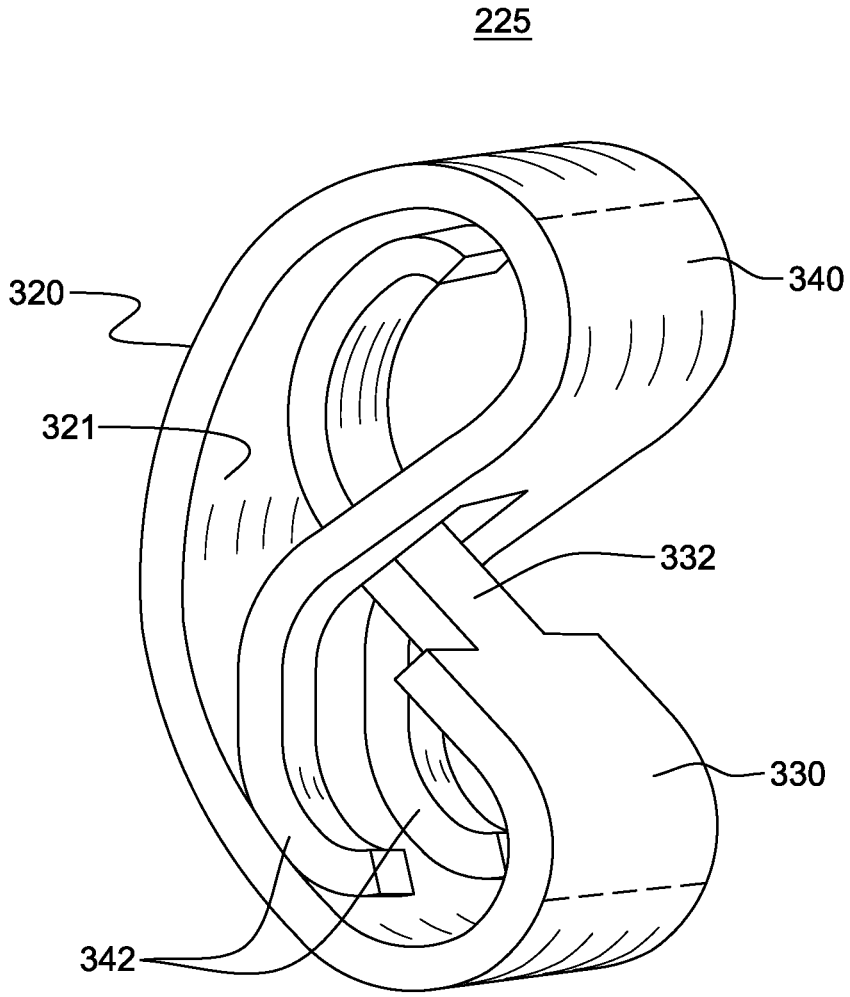
FIG. 3C depicts one electrically-conductive, compressive conductor of the electrical interconnect of FIGS. 2, 3A & 3B, shown in uncompressed state, in accordance with one or more aspects of the present invention.
Figure 4A:
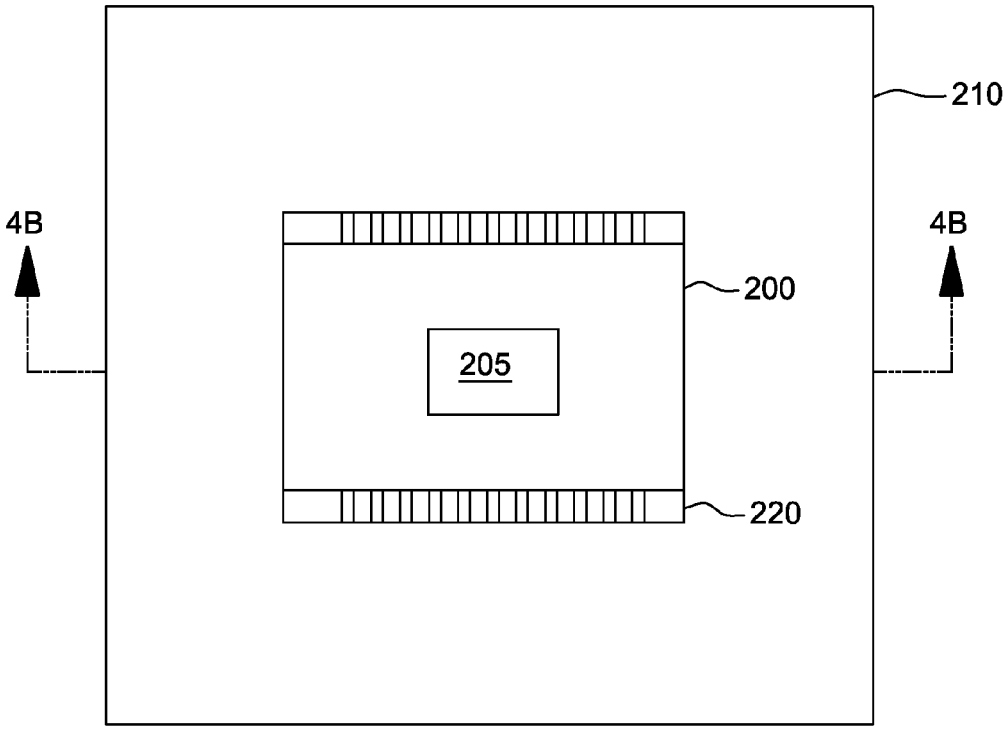
FIG. 4A is a top plan view of the assembled electronic apparatus of FIG. 2, utilizing the electrical interconnect of FIGS. 3A-3C, in accordance with one or more aspects of the present invention.
Figure 4B:
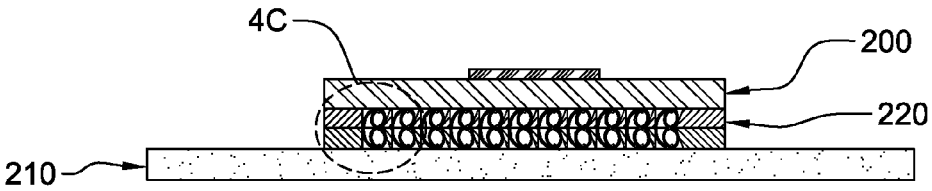
FIG. 4B is a cross-sectional elevational view of the assembled electronic apparatus of FIG. 4A, taken along line 4B-4B thereof, in accordance with one or more aspects of the present invention.
Figure 4C:
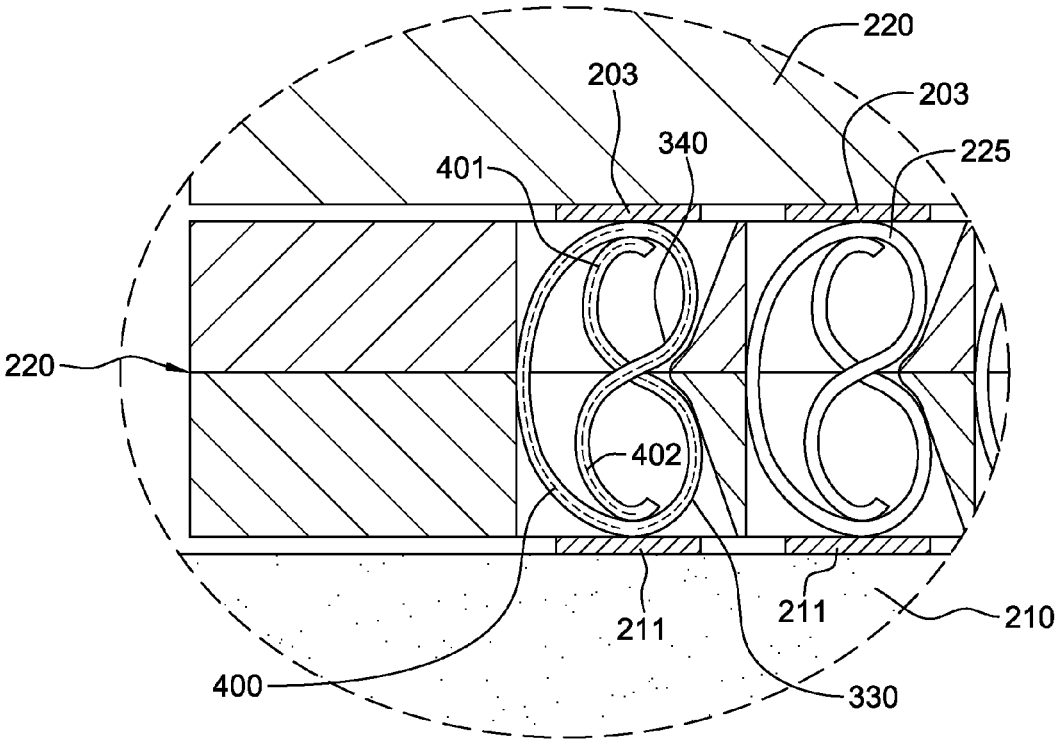
FIG. 4C is a partial enlargement of the assembled electronic apparatus of FIG. 4B, taken within line 4C thereof, and illustrating the electrically-conductive, compressible conductors in compressed (or loaded) state, making electrical connection between the module substrate and the wiring board, in accordance with one or more aspects of the present invention.

As noted, FIG. 4A depicts a top plan view of the assembled electronic apparatus of FIGS. 2-3C, with interposer structure 220 disposed between module substrate 200 and wiring board 210. In the embodiment illustrated, one or more integrated circuit chips 205 are disposed on module substrate 200. In the cross-sectional elevational view of FIGS. 4B & 4C, the electrically-conductive, compressible conductors 225 are shown under load, making electrical connection between the first and second arrays of contacts 203, 211 disposed in opposing relation on the facing surfaces of the module substrate 200 and wiring board 210. In this regard, note that the compressible conductors 225 slidingly contact or wipe contacts 203, 211 as the conductors compress, which ensure a good electrical connection between the compressible conductors and the contacts.

Note that advantageously, there are multiple current paths through the compressive conductors when operationally disposed under compression between two electrically-conducting contacts of the first and second arrays of contacts. These current paths include (in the depicted configuration) a first current path 400 through the C-shaped portion of the compressible conductor, a second current 401 path extending, at least partially, through the first conductor end portion 330 of the compressible conductor, and a third current path 402 extending at least partially through the second conductor end portion 340 of the compressible conductor. Note that, in operation, the multiple current paths through the compressible conductor advantageously reduce resistance of the conductor.

Those skilled in the art will note from the description provided herein, that the compressible conductors (or contact buttons) disclosed can be readily, selectively replaced within an interposer structure, that is, if found to be defective. Further, the compressible conductors disclosed are free of any features that would make them prone to being caught within the interposer material, or bent due to handling. Additionally, electrical connection resistance is less, for example, half or less that of other connectors (such as the above-described, spring-type connectors of FIGS. 1A & 1B), since the compressive conductors disclosed herein have multiple electrical paths through the compressible conductor. Further, the compressible conductors disclosed herein, in association with the above-described side wall protrusions within the respective openings, eliminate contact rotation due to less than perfect loading of the respective compressible conductors. Contact rotation is undesirable because it would reduce the normal force between the compressible conductor and the respective contacts, and result in poor conductor retention within the housing. The compressible conductors disclosed herein also advantageously provide a small footprint, which results in less cross-talk between adjacent contacts, and thereby, higher speed performance.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

What is claimed is:

1. An electrical interconnect comprising:

an electrically-conductive, compressible conductor comprising:

a first conductor end portion and a second conductor end portion, the first conductor end portion and the second conductor end portion physically contacting each other and moving in slidable relation relative to each other with compression of the electrically-conductive, compressible conductor and the first conductor end portion and the second conductor end portion each physically contacting in slidable relation an inner-facing surface of the electrically conductive, compressible conductor with compression of the electrically-conductive, compressible conductor to, at least in part, facilitate inhibiting rotation of the electrically-conductive, compressible conductor with compression thereof.

2. The electrical interconnect of claim 1, wherein the first conductor end portion comprises at least one first leg and the second conductor end portion comprises at least two second legs, and wherein the at least one first leg of the first conductor end portion and the at least two second legs of the second conductor end portion are interdigitated.

3. The electrical interconnect of claim 1, wherein the electrically-conductive, compressible conductor comprises a partially C-shaped structure with a C-shaped portion, and the first conductor end portion and the second conductor end portion extend from different ends of the C-shaped portion.

4. The electrical interconnect of claim 3, wherein the first conductor end portion and the second conductor end portion each physically contact in slidable relation an inner-facing surface of the C-shaped portion of the partially C-shaped structure, the inner-facing surface of the C-shaped portion of the partially C-shaped structure being the inner-facing surface of the electrically-conductive, compressible conductor.

5. The electrical interconnect of claim 1, wherein the electrically-conductive, compressible conductor comprises multiple current paths therethrough between two electrically-conducting contacts when the electrically-conductive, compressible conductor is operatively disposed between the two electrically-conducting contacts, at least one current path of the multiple current paths between the two electrically-conducting contacts passing through at least one of the first conductor end portion or the second conductor end portion.

6. The electrical interconnect of claim 1, further comprising a land grid array interposer, and wherein the electrically-conductive, compressible conductor resides within a respective opening in the land grid array interposer.

7. The electrical interconnect of claim 6, wherein the land grid array interposer comprises an inner side wall defining, at least in part, the respective opening, the inner side wall comprising a side wall protrusion, the side wall protrusion extending at least partially between the first conductor end portion and the second conductor end portion of the electrically-conductive, compressible conductor to facilitate maintaining the electrically-conductive, compressible conductor in position within the respective opening.

8. An electronic apparatus comprising:

an interposer; and a plurality of electrically-conductive, compressible conductors disposed within the interposer, at least one electrically-conductive, compressible conductor of the plurality of electrically-conductive, compressible conductors comprising:

a first conductor end portion and a second conductor end portion, the first conductor end portion and the second conductor end portion physically contacting each other and moving in slidable relation relative to each other with compression of the electrically-conductive, compressible conductor and the first conductor end portion and the second conductor end portion each physically contacting in slidable relation an inner-facing surface of the electrically conductive, compressible conductor with compression of the electrically-conductive, compressible conductor to, at least in part, facilitate inhibiting rotation of the electrically-conductive, compressible conductor with compression thereof.

9. The electronic apparatus of claim 8, further comprising;

a first package structure comprising a package substrate with one or more electronic devices mounted on a first surface of the package substrate, and a first array of contacts of pitch P1 formed on a second surface of the package substrate opposite the first surface;

a second package structure comprising a wiring board with a second array of contacts of pitch P1 disposed on a first surface thereof; and wherein the interposer comprises a land grid array interposer disposed between the first and second package structures to provide electrical interconnections between the first and second arrays of contacts via the plurality of electrically-conductive, compressible conductors.

10. The electronic apparatus of claim 8, wherein the first conductor end portion comprises at least one first leg and the second conductor end portion comprises at least two second legs, and wherein the at least one first leg of the first conductor end portion and the at least two second legs of the second conductor end portion are interdigitated.

11. The electronic apparatus of claim 8, wherein the at least one electrically-conductive, compressible conductor comprises a partially C-shaped structure with a C-shaped portion, and the first conductor end portion and the second conductor end portion extend from different ends of the C-shaped portion.

12. The electronic apparatus of claim 11, wherein the first conductor end portion and the second conductor end portion each physically contact in slidable relation an inner-facing surface of the C-shaped portion of the partially C-shaped structure, the inner-facing surface of the C-shaped portion of the partially C-shaped structure being the inner-facing surface of the electrically-conductive, compressible conductor.

13. The electronic apparatus of claim 8, wherein one electrically-conductive, compressible conductor of the at least one electrically-conductive, compressible conductor comprises multiple current paths therethrough between two electrically-conducting contacts when the one electrically-conductive, compressible conductor is operatively disposed between the two electrically-conducting contacts, at least one current path of the multiple current paths between the two electrically-conducting contacts passing through at least one of the first conductor end portion or the second conductor end portion of the one electrically-conductive, compressive conductor.

14. The electronic apparatus of claim 13, wherein the at least one electrically-conductive, compressible conductor resides within at least one respective opening in the interposer, the interposer comprising an inner side wall defining, at least in part, the at least one respective opening, and the inner side wall comprising a side wall protrusion, the side wall protrusion extending at least partially between the first conductor end portion and the second conductor end portion of the one electrically-conductive, compressible conductor of the at least one electrically-conductive, compressible conductor to facilitate maintaining the one electrically-conductive, compressible conductor in position within the respective opening.

15. A method of fabricating an electrical interconnect comprising:

providing an interposer;

providing an electrically-conductive, compressible conductor comprising:

a first conductor end portion and a second conductor end portion, the first conductor end portion and the second conductor end portion physically contacting each other and moving in slidable relation relative to each other with compression of the electrically-conductive, compressible conductor and the first conductor end portion and the second conductor end portion each physically contacting in slidable relation an inner-facing surface of the electrically conductive, compressible conductor with compression of the electrically-conductive, compressible conductor to, at least in part, facilitate inhibiting rotation of the electrically-conductive, compressible conductor with compression thereof; and disposing the electrically-conductive, compressible conductor within the interposer, wherein in uncompressed state, the electrically-conductive, compressible conductor extends beyond a first surface and a second surface of the interposer, the first and second surfaces being opposite main surfaces of the interposer.

16. The method of claim 15, wherein the first conductor end portion comprises at least one first leg and the second conductor end portion comprises at least two second legs, and wherein the at least one first leg of the first conductor end portion and the at least two second legs of the second conductor end portion are interdigitated.

17. The method of claim 15, wherein the electrically conductive, compressible conductor comprises a partially C-shaped structure with a C-shaped portion, and the first conductor end portion and the second conductor end portion extend from different ends of the C-shaped portion, and wherein the first conductor end portion and the second conductor end portion each physically contact in slidable relation an inner-facing surface of the C-shaped portion of the partially C-shaped structure, the inner-facing surface of the C-shaped portion of the partially C-shaped structure being the inner-facing surface of the electrically-conductive, compressible conductor.

* * * * *